US005116247A

United States Patent [19]

Enomoto et al.

[11] Patent Number: 5,116,247

[45] Date of Patent: May 26, 1992

[54] BOARD-TO-BOARD ELECTRIC CONNECTOR HAVING MALE AND FEMALE TERMINALS AT REDUCED PITCH

[75] Inventors: Masahiro Enomoto, Inagi; Minoru Fukushima, Kanagawa; Shinichi Aihara, Atsugi, all of Japan

[73] Assignee: Molex Incorporated, Lisle, Ill.

[21] Appl. No.: 694,712

[22] Filed: May 2, 1991

[30] . Foreign Application Priority Data

May 29, 1990 [JP] Japan ..... 2-56272[U]

[51] Int. Cl.[5] ..... H01R 13/00

[52] U.S. Cl. ..... 439/660; 439/699

[58] Field of Search ..... 439/660, 699

[56] References Cited

U.S. PATENT DOCUMENTS 3,960,434 6/1976 Soes ..... 439/660

4,734,060 3/1988 Kawawada et al. ..... 439/660

*Primary Examiner*—Joseph H. McGlynn

*Attorney, Agent, or Firm*—Stephen Z. Weiss

[57] ABSTRACT

Disclosed is a board-to-board electric connector using terminals whose width is same in size as the thickness of metal sheet from which terminals are stamped out, thereby permitting reduction of terminal pitch to possible minimum simply by selecting the metal sheet.

6 Claims, 6 Drawing Sheets

BOARD-TO-BOARD ELECTRIC CONNECTOR HAVING MALE AND FEMALE TERMINALS AT REDUCED PITCH

BACKGROUND OF THE INVENTION

The present invention relates to a board-to-board electric connector, and more particularly such an electric connector comprising a male plug and a female socket each having a plurality of terminals arranged at a narrow pitch and means to prevent each terminal from moving laterally in the direction in which the terminals are arranged.

DESCRIPTION OF THE PRIOR ART

A variety of electric connector are used to make electrical connections between circuits printed on different boards. There has been an ever increasing demand for a high-density package of electric parts. This requires reduction of terminal pitch in an electric connector housing to the lowest possible minimum. Such a low pitch includes a center-to center distance of 0.5 mm. In an attempt to meet the demand for the lowest possible limit, terminals to be mounted in a housing are stamped out of metal sheet, and then each terminal is given such a configuration that it may have the most narrow possible contact surface, thereby permitting reduction of terminal pitch.

This prior art, however, cannot reduce the terminal pitch below a certain limit. The present invention aims at the reduction of the terminal pitch still below such limit.

SUMMARY OF INVENTION

The object of the present invention is to provide board-to board electric connector comprising male plug and female socket each having a plurality of terminals arranged at the narrowest pitch possible. These terminals are prevented from moving laterally in the direction in which the terminals are arranged, thus preventing the inaccurate side-to-side contact between terminals when the male plug is inserted in the female socket.

To attain this object a board-to-board electric connector comprising a female socket having a plurality of female terminals arranged at a narrow regular pitch in its housing and a male plug having a plurality of male terminals arranged at a narrow regular pitch in its housing, is improved. This improvement, according to the present invention, includes the female and male terminals having contact surfaces coming in contact with each other when said female socket and male plug are coupled, the contact surfaces of said male and female terminals being of the same width as the thickness of metal sheet from which the female and male terminals are stamped out.

The female terminals may be inserted in slots which are made in the housing of the female socket. The opposite side walls of each slot prevent the female terminal from moving laterally. Likewise, the male terminals are inserted in slots which are made in the housing of the male socket. The opposite side walls of each slot prevent the male terminal from moving laterally.

Each slot accommodating an associated male terminal may be designed so as to allow the male terminal to project from the slot one half of the width of the male terminal or more whereas each slot to accommodate an associated female terminal may be designed so as to have a depth enough to allow the female terminal to fit and remain flush with the slot top edge when the female socket and male plug are not coupled. Each male terminal is permitted to invade into the corresponding slot of the female terminal thereby causing the female terminal therein to yieldingly withdraw when said female socket and male plug are coupled. All female terminals may be insert-molded in the female socket housing and all male terminals may be insert-molded in the male plug housing.

Use of the thickness of the metal sheet to provide the terminal contact surface permits reduction of width of the male and female terminal contact surfaces to a desired narrow size simply by selecting the thickness of the metal sheet from which terminals are to be stamped out. Metal sheets can be selected with a view to attain the arrangement of terminals at a required narrow pitch. Each of these male and female terminals are inserted in slots, thereby preventing the lateral shift of each terminal by opposite side walls of each slot, and permitting male terminal contact surfaces to be put in exact registration of female terminal contact surfaces when a male plug is inserted in a female socket.

Other objects and advantages of the present invention will be understood from the following description of preferred embodiments, which are shown in accompanying drawings:

DETAILED DESCRIPTION OF THE INVENTION

Figure 3:
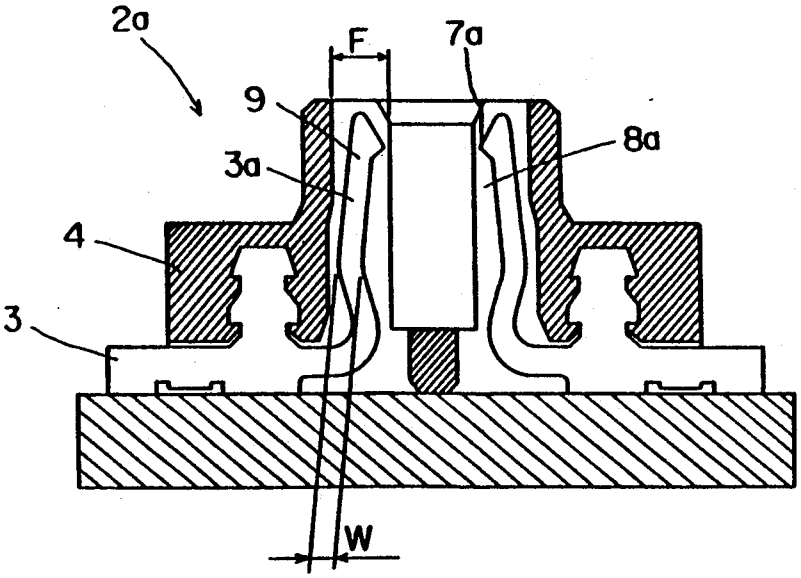
FIG. 3 is a sectional view of the female socket of the electric connector taken along the line 3—3 in FIG. 1
Figure 1:
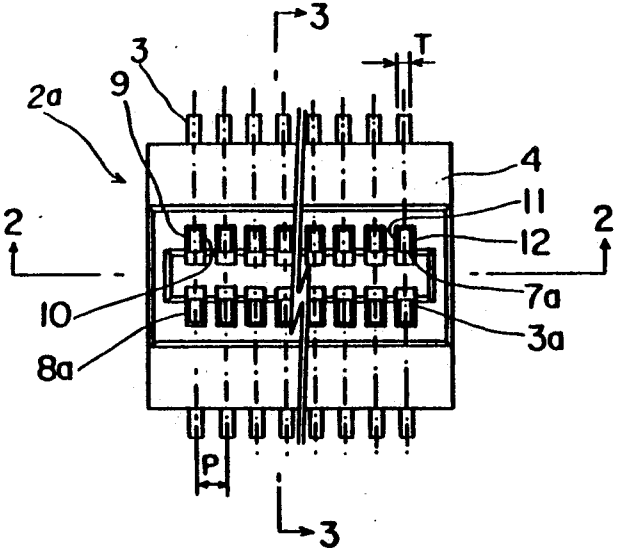
FIG. 1 is a top view of the female socket of the first embodiment of the electric connector.
Figure 2:
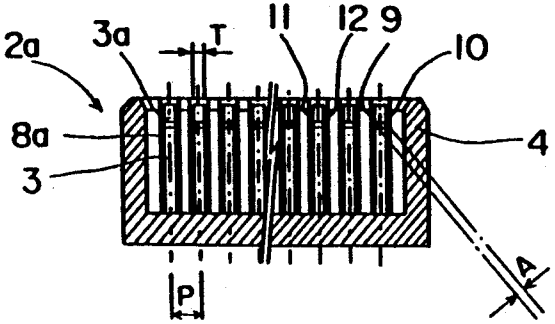
FIG. 2 is a sectional view of the female socket of the electric connector taken along the line 2—2 in FIG. 1
Figure 6:
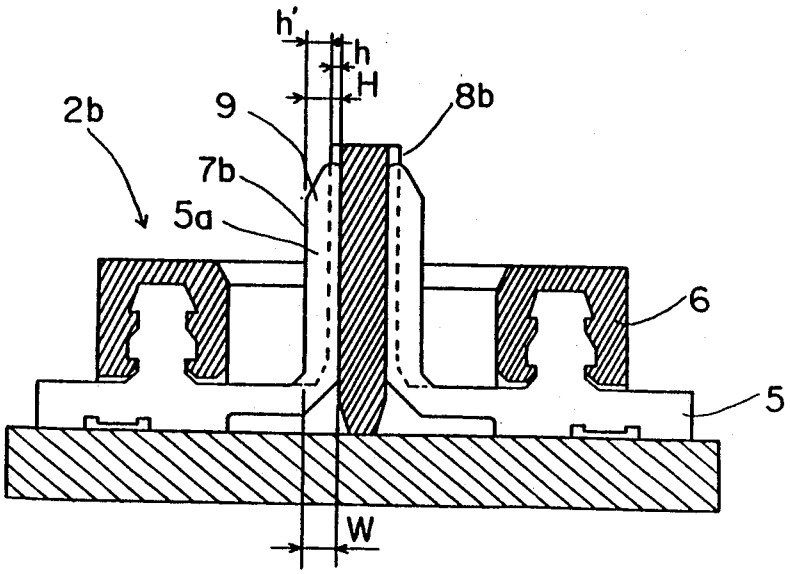
FIG. 6 is a sectional view of the male plug of the electric connector taken along the line 6—6 in FIG. 4.
Figure 4:
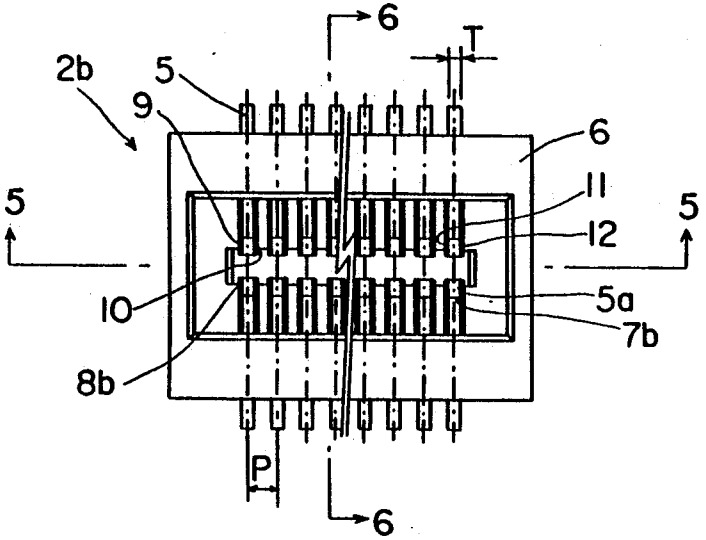
FIG. 4 is a top view of the male plug of the electric connector.
Figure 5:
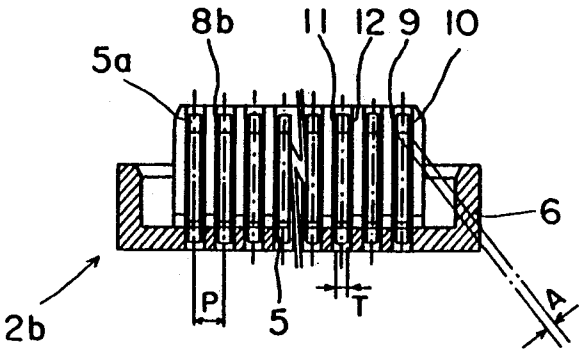
FIG. 5 is a sectional view of the male plug of the electric connector taken along the line 5—5 in FIG. 4.

Referring to FIGS. 1 to 7, there is shown an electric connector according to the first embodiment of the present invention, generally indicated 2. The electric connector 2 comprises a female socket 2*a* as shown in FIGS. 1 to 3 and male plug 2*b* as shown in FIGS. 4 to 6.

Female socket 2*a* has a plurality of female terminals arranged at a narrow regular pitch P in its housing 4 whereas male plug 2*b* has a plurality of male terminals 5 arranged at the same narrow regular pitch P in its housing 6.

When the male and female parts are mated with each other, the male and female terminals come to contact, thereby making electrical connection between associated printed circuit boards 14 and 16. Each female terminal 3 has a contact surface 7*a* of a predetermined width A whereas each male terminal 5 has a contact surface 7*b* of the same width A.

The contact surfaces 7*a* and 7*b* of male and female terminals are of the same width A as the thickness T of metal sheet from which female and male terminals are stamped out. Male and female terminals are of the same width W, which can be selected and measured in the plane of metal sheet.

These female and male terminals 3 and 5 are fixed to housings 4 and 6. Specifically, female terminals 3 are inserted in slots 8*a* which are made in the housing of female socket 2*a*. The opposite side walls 11 and 12 of each slot prevent the female terminal from moving laterally. Likewise, male terminals 5 are inserted in slots 8*b* which are made in the housing 6 of male plug 2*b*. The opposite side walls 11 and 12 of each slot prevent the male terminal from moving laterally.

Each slot 8*b* is designed so as to allow an associated male terminal 5 to project from the slot one half of the width H of the male terminal 5. Specifically, h' (projection width) is equal to H (width of the male terminal) minus h (depth of the slot measured in the same direction as width H of the male terminal, or called "insertion width"), and is equal to H/2 or more (FIG. 6).

Figure 7:
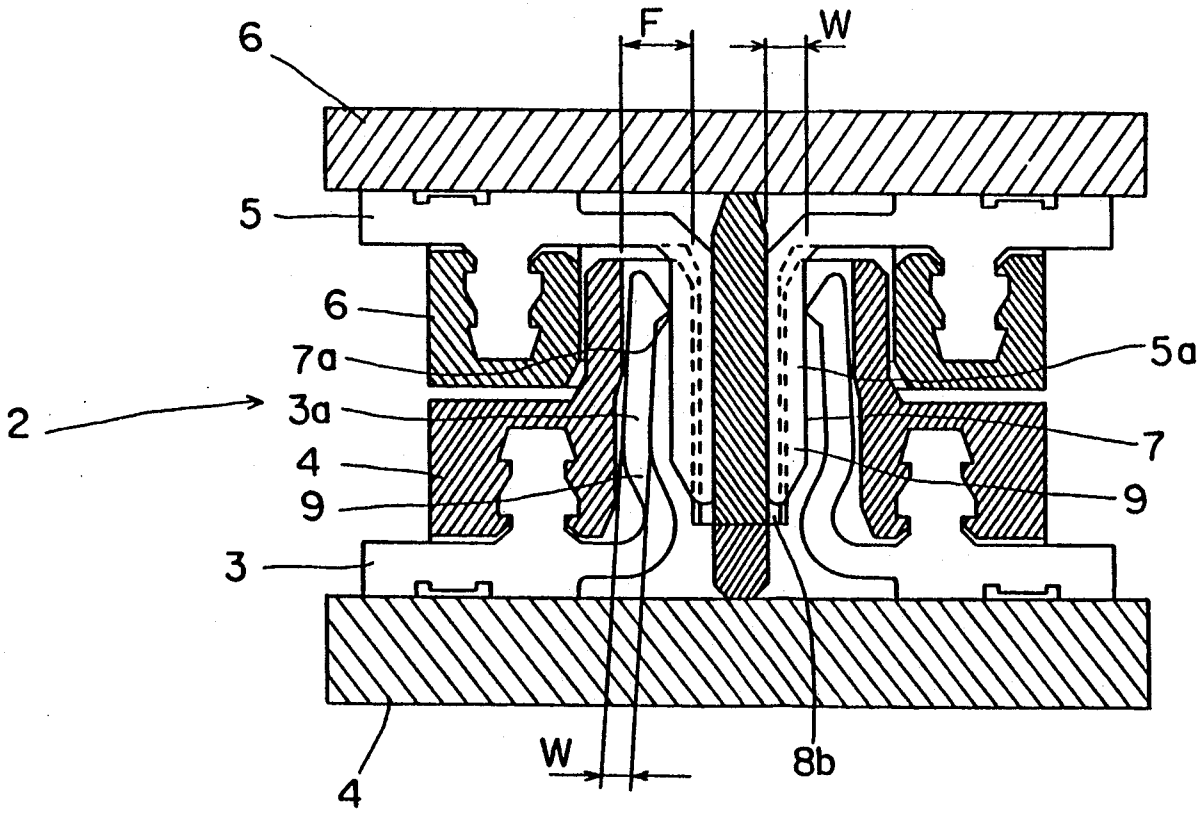
FIG. 7 shows, in section, the electric connector with its male plug inserted in its female socket.
Figure 10:
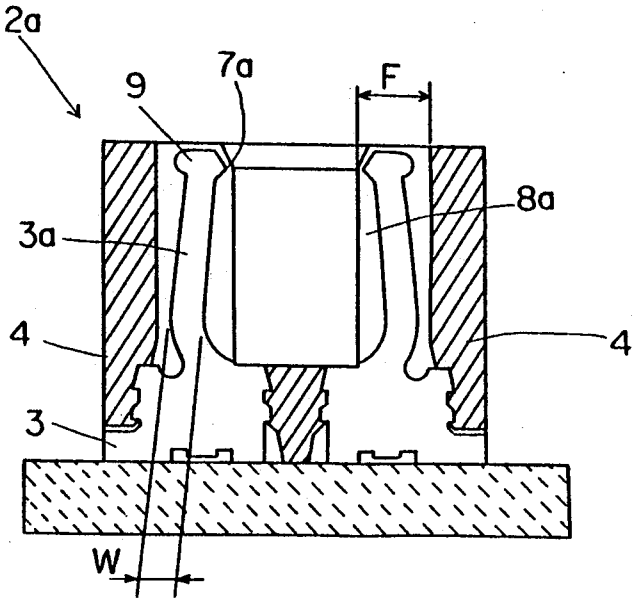
FIG. 10 is a sectional view of the female socket of the electric connector taken along the line 10—10 in FIG.
Figure 8:
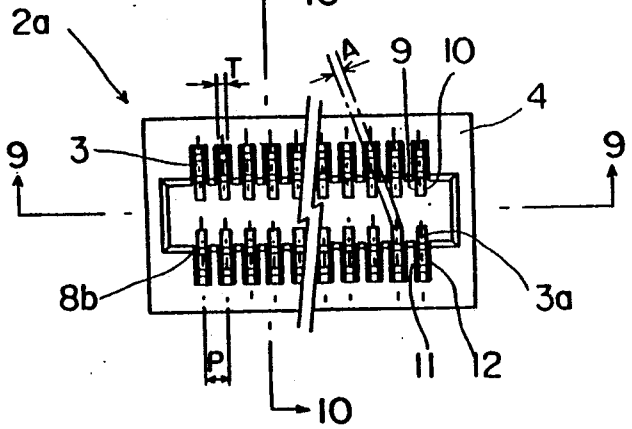
FIG. 8 is a top view of the female socket of the second embodiment of the electric connector.
Figure 9:
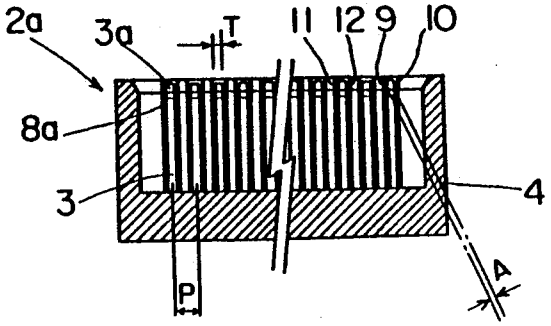
FIG. 9 is a sectional view of the female socket of the electric connector taken along the line 9—9 in FIG. 8.
Figure 13:
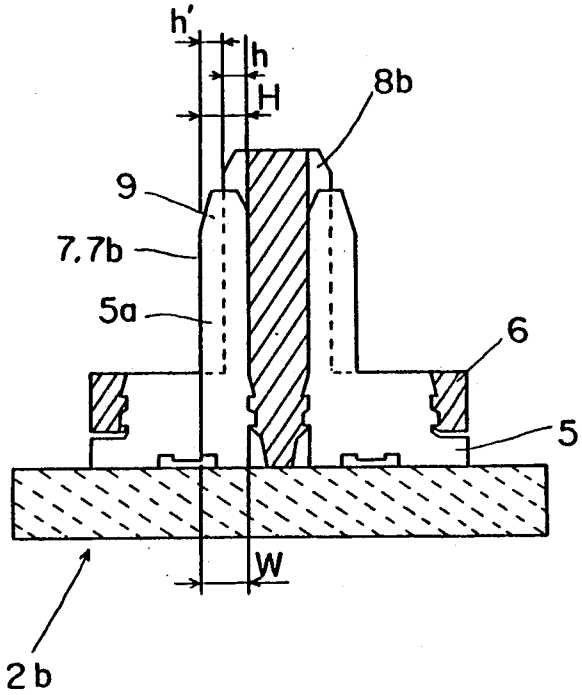
FIG. 13 is a sectional view of the male plug of the electric connector taken along the line 13—13 in FIG. 11.
Figure 11:
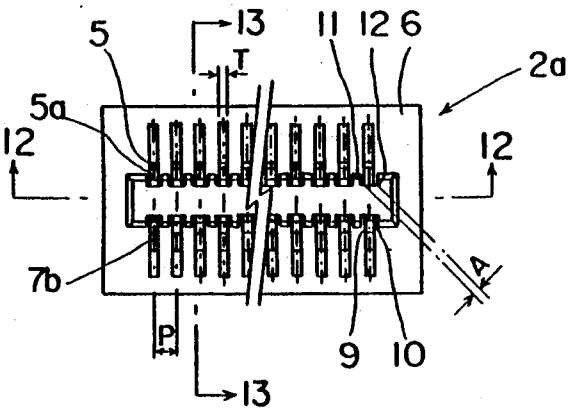
FIG. 11 is a top view of the male plug of the electric connector.
Figure 12:
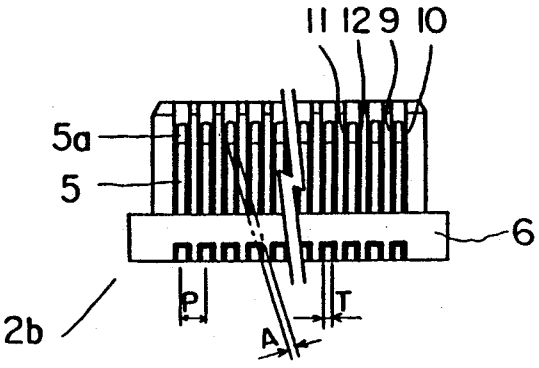
FIG. 12 is a sectional view of the male plug of the electric connector taken along the line 12—12 in FIG. 11.
Figure 14:
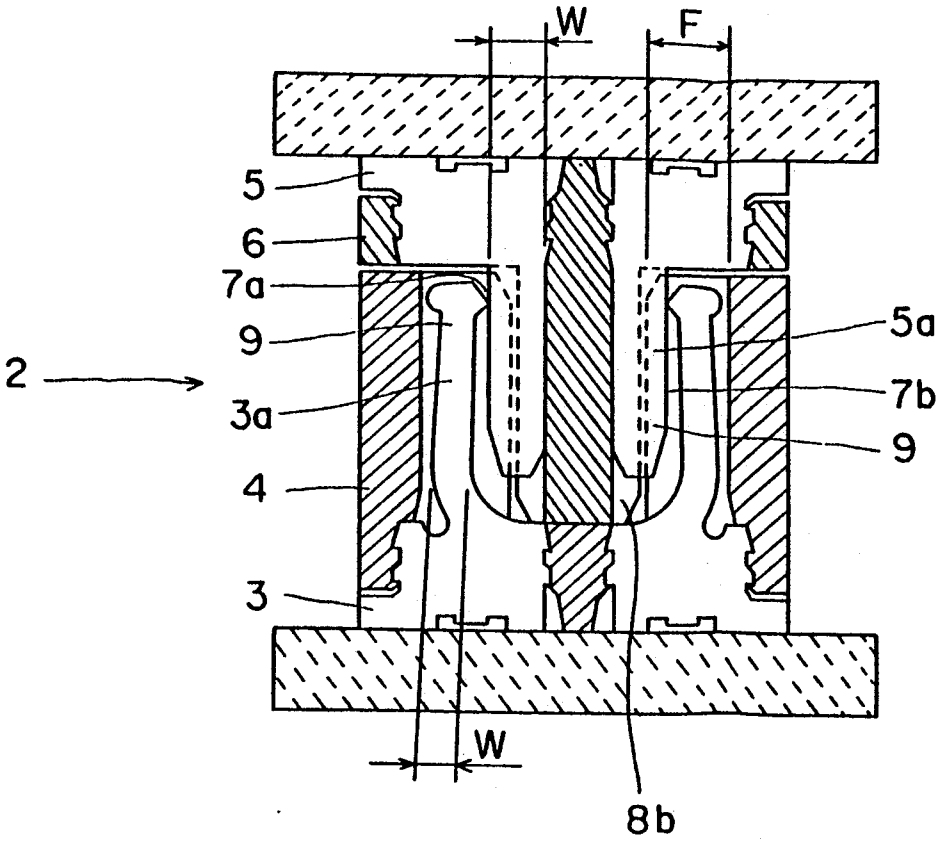
FIG. 14 shows, in section, the electric connector with its male plug inserted in its female socket.

On the other hand, each slot 8*a* is designed so as to have a depth F enough to allow an associated female terminal 3 to fit and remain flush with slot top edge when female socket and male plug are not coupled, that is, female and male terminals are not put in contact condition. The projection width h' of each male terminal is permitted to invade into the corresponding slot 8*a* by causing the female terminal therein to yieldingly withdraw when female socket and male plug are coupled (FIG. 7).

Although female terminals 3 can be fixed to housing 4 by inserting them in slots 8*a* made in housing 4, it is convenient and preferable that all female terminals 3 be insert-molded in the housing of the female socket. Also, preferably all male terminals 5 may insert-molded in the housing of the male plug.

Referring to FIGS. 8 to 13, there is shown an electric connector according to the second embodiment of the present invention, which is substantially the same as the first embodiment. The same parts appearing in FIGS. 8 to 13 are indicated by the same reference numerals as used in FIGS. 1 to 7.

The electric connector comprises a female socket 2*a* and male plug 2*b* which are designed to be mated with each other.

When the male and female parts are mated together, the female terminals 3 and male terminals 5 come into contact with each other by their contact surfaces 7*a* and 7*b* respectively. The width A of each terminal contact surface is same in size as the thickness T of metal sheet from which the female and male terminals are stamped.

The contact width A can be reduced to a possible minimum thickness. Thus, arrangement of male or female terminals at minimum pitch in housing 4 or 6 can be easily attained.

These female and male terminals 3 and 5 are fixed to housing 4 and 6 by inserting female terminals 3 in slots 8*a* of housing 4 and by inserting male terminals 5 in slots 8*b* of housing 6. The opposite side walls 11 and 12 of each slot 8*a* or 8*b* prevent the terminal from moving laterally, thereby keeping each terminal in such an exact position that the female terminals fixed in socket housing 4 and the male terminals in plug housing 6 may be put in registration when male plug 2*a* is inserted in female socket 2*b*, no matter how narrow the contact width may be.

As may be understood from the above, an electrical connector according to the present invention uses terminals whose width is same in size as the thickness of metal sheet from which terminals are stamped out, thereby permitting reduction of terminal pitch to a possible minimum simply by selecting thin metal sheet.

We claim:

1. A board-to-board electric connector comprising a female socket having a plurality of female terminals arranged at narrow regular pitch and means for holding said female terminals in a housing and a male plug having a plurality of male terminals arranged at narrow pitch and means for holding said male terminals in its housing, characterized in that:

said female and male terminals have terminal contact surfaces which come into contact with each other when said female socket and male plug are coupled and board mounting means, the contact surfaces and the board mounting means of said male and female terminals being the same width as the thickness of the metal sheet from which said female and male terminals are stamped, said male terminal having a housing contact surface opposite said terminal contact surfaces;

said female terminals inserted into female terminal slots having an inner bottom end and an opposite top edge which are made in the housing of said female socket, allowing the opposite side walls of each female terminal slot to prevent the female terminal from moving laterally, and said male terminals inserted into male terminal slots having an inner bottom end and an opposite top edge which are made in the housing of said male socket allowing the opposite side walls of each slot to prevent the male terminal from moving laterally and said male terminal slot inner bottom end to contact said terminal contact surface of said male terminal to prevent the male terminal from moving in the plane of the terminal in a direction toward the male terminal inner bottom end;

said male terminal slots designed so as to allow the male terminal contact surface to project one half of the width of the male terminal or more beyond the top edge of the side walls of each male terminal slot, said female terminal slots designed so as to have a depth to allow the female terminal to fit and remain flush with said female terminal slot top edge when said female socket and male plug are not coupled and where the projecting portion of said male terminal beyond said male terminal slot sidewalls are allowed to enter the corresponding female terminal slot by causing the female terminal therein to yieldingly withdraw when said female socket and male plug are coupled.

2. The board-to-board electrical connector according to claim 1 wherein said male terminal contact surface is generally straight with a portion of said terminal first making contact with said mating male terminal having a ramp formed therein to provide a more gradual increase of the mating force of the terminals.

3. The board-to-board electrical connector according to claim 2 wherein said male and female terminal board mounting means includes a flat section which contacts and is electrically connected to the surface of a printed circuit board.

4. The board-to-board electric connector according to claim 1 wherein said means for holding each of said female terminals include the terminals insert-molded into the housing of said female socket and wherein said means for holding each of said male terminals include the terminals insert-molded into the housing of said male plug.

5. The board-to-board electric connector according to claim 4 wherein said female terminal has a cantilevered portion with a free end of said cantilevered portion extending in a direction so that the free end will contact the mating male terminal first.

6. The board-to-board electric connector according to claim 5 wherein said female terminal has an enlarged portion on its contact surface extending toward the contact surface of the male terminal, where said enlarged portion is located near the free end of said female terminal whereby said enlarged portion will be the only portion of said female contact surface which will contact said male terminal.

* * * * *